US006530456B1

(12) United States Patent
Wallther

(10) Patent No.: US 6,530,456 B1
(45) Date of Patent: Mar. 11, 2003

(54) LOCKING DEVICE FOR SCAFFOLDING ELEMENTS

(75) Inventor: Harry Wallther, Hindås (SE)

(73) Assignee: PlusEight Technology AB (SE)

( * ) Notice: Subject to any disclaimer, the term of this patent is extended or adjusted under 35 U.S.C. 154(b) by 0 days.

(21) Appl. No.: 09/958,396

(22) PCT Filed: Apr. 7, 2000

(86) PCT No.: PCT/SE00/00667

§ 371 (c)(1),
(2), (4) Date: Dec. 19, 2001

(87) PCT Pub. No.: WO00/61891

PCT Pub. Date: Oct. 19, 2000

(30) Foreign Application Priority Data

Apr. 9, 1999 (SE) ..... 9901259

(51) Int. Cl.[7] ..... E04G 1/15
(52) U.S. Cl. ..... 182/222; 182/119; 182/18
(58) Field of Search ..... 182/119, 222, 182/18, 273

(56) References Cited

U.S. PATENT DOCUMENTS 2,997,767 A * 8/1961 Grover

FOREIGN PATENT DOCUMENTS

| | | |
|---|---|---|
| CA | 2 194 233 | 1/1996 |
| EP | 0 305 014 | 3/1989 |
| FR | 2 083 214 | 12/1971 |
| FR | 2 719 066 | 10/1995 |
| GB | 2 127 086 | 4/1984 |
| GB | 2174747 | * 11/1986 |
| GB | 2 218 146 A | 11/1989 |

* cited by examiner

*Primary Examiner*—Alvin Chin-Shue
(74) *Attorney, Agent, or Firm*—Lerner, David, Littenberg, Krumholz & Mentlik, LLP

(57) ABSTRACT

The invention relates to scaffolding, especially facade scaffolding, comprising vertical poles (11) located one behind the other, preferably in pairs, and interconnected at given vertical intervals by means of cross struts (12). Said vertical poles (11) consist preferably of individual elements (11') and form support frames (43) with said cross struts (12). Base plates (13) are also positioned between the cross struts (12) of neighbouring support frames (43). Diagonal poles (27) are arranged between at least some of the neighbouring vertical poles (11). According to the invention, scaffolding of this type is configured in such a way that at least one end of the diagonal poles (27) engages in an aperture (16) provided in the designated vertical pole (11) by means of a hook (15, 15'). Said opening lies at least essentially in the plane defined by the axes (17) of the neighbouring vertical poles (11).

6 Claims, 6 Drawing Sheets

LOCKING DEVICE FOR SCAFFOLDING ELEMENTS

TECHNICAL FIELD

The present invention relates to a locking device for scaffold platforms which are provided with a number of hook elements which protrude from at least two of the sides of the platform in order to, when mounted, be hooked up on lying scaffold elements in a scaffold, wherein the locking device is adjustable between a release position, in which the platforms can be unhooked from accompanying scaffold elements, and a lock position, in which the platform is locked to the scaffold element.

BACKGROUND OF THE INVENTION

Due to the fact that they disclose a high degree of security and a uniform strength, scaffold platforms are nowadays used in order to replace planks. Scaffold platforms are used in order to uphold individuals and other load in scaffolds, but can be used in a number of situations where temporary, movable scaffolds or stands are used, for example for stage constructions for artist appearances, bridges, landing-stages etc. The platforms can be provided with locking devices for locking accompanying hook elements to lying scaffold elements. The hook elements are open downwards, for which reason the locking devices, and in particular their active part, are arranged so that they essentially are visible from the under side of the platforms. On assembly, the hook elements are first hooked on to the lying scaffold elements so that the platforms rest on these. Next, a separate measure is required in order to adjust the locking device from a release position to lock position. Since the platform is supported in the scaffold in release position as well, there is a risk that the locking measure is not carried out, something which in previously known locking devices is unable to be observed when the platform is used, i.e. when individuals are situated on the platform. During unfavourable conditions of loading, the platform may be removed out of its position and be unhooked from the lying scaffold elements. The fact is, that lock position not only means that the platform is kept in its place, but it contributes also to a high degree to the overall strength and stability of the scaffold.

SUMMARY OF THE INVENTION

The object of the present invention is to provide a locking device, by means of which the above-mentioned disadvantages are eliminated.

Said object is achieved by means of the locking device according to the invention, which is characterized in that the locking device is constituted by at least one displaceable locking slide which is movable in a guide device between, on the one hand, the release position, in which the accompanying scaffold element can be inserted into and taken out of, respectively, the hook elements and, on the other hand, the lock position, in which the slide blocks the scaffold element in the hook elements, combined with that the locking slide is provided with an indication section, which follows the locking slide's adjustment movement between release position and lock position and is adapted to, in release position, protrude clearly visible for an observer from the upper side of the platform for ocular indication that the platform is unlocked, wherein the locking slide is curved and movable in the guide device along a curved path.

By means of the locking device according to the invention, a clear, visible indication of the lock status of the locking device is obtained, which indication is obtained from the upper side of the platform as well, i.e. where users are situated.

BRIEF DESCRIPTION OF THE DRAWINGS

The invention will be further described in the following with reference to a preferred embodiment and to the appended drawings, in which.

PREFERRED EMBODIMENT

Figure 1:
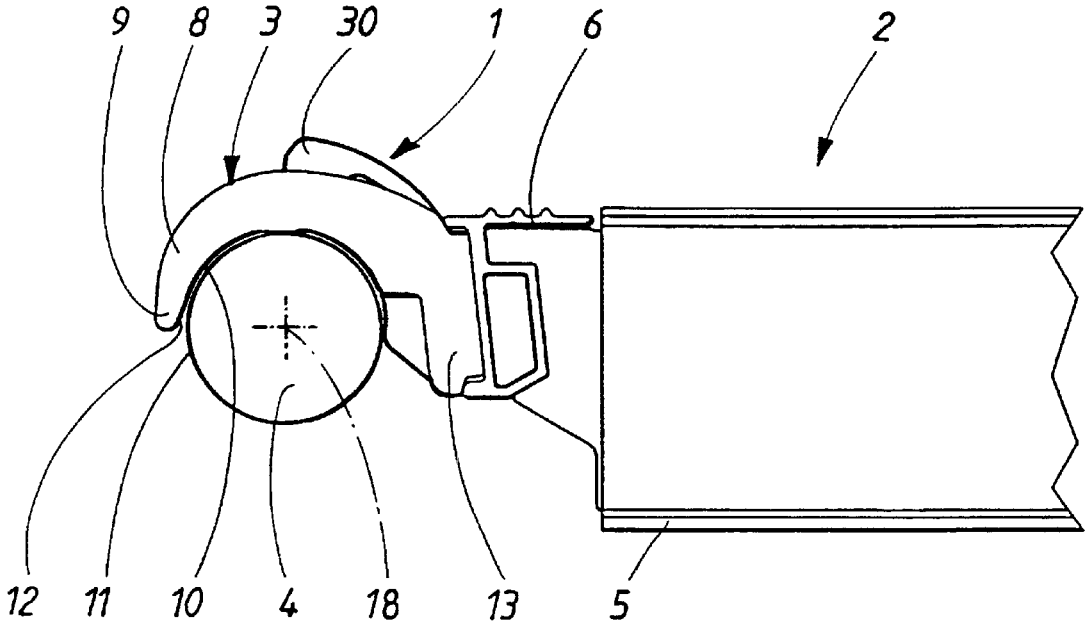
FIGS. 1 and 2 show partly broken side views of a scaffold platform with a locking device according to the invention in release position and lock position, respectively.
Figure 2:
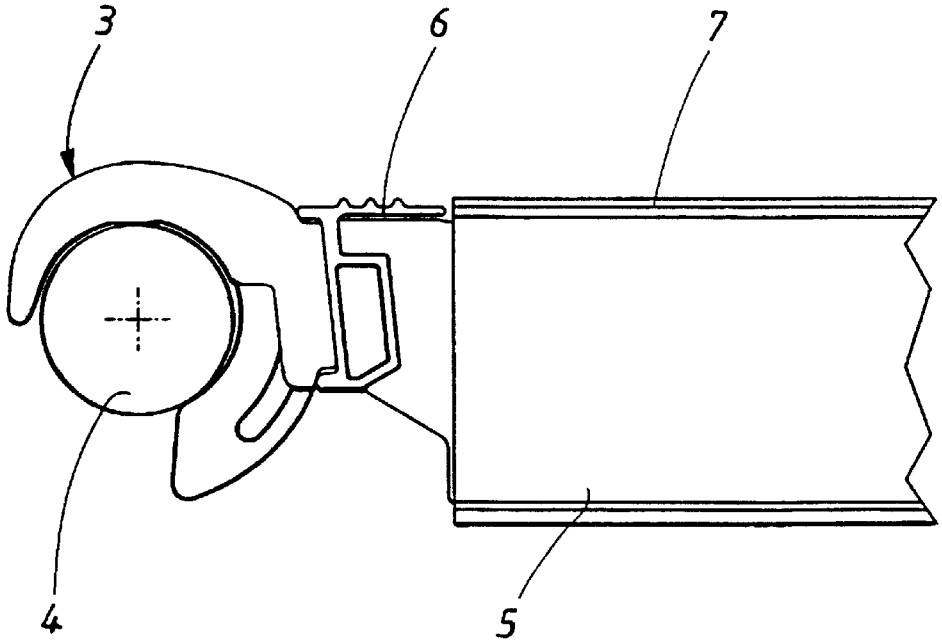
Figure 3:
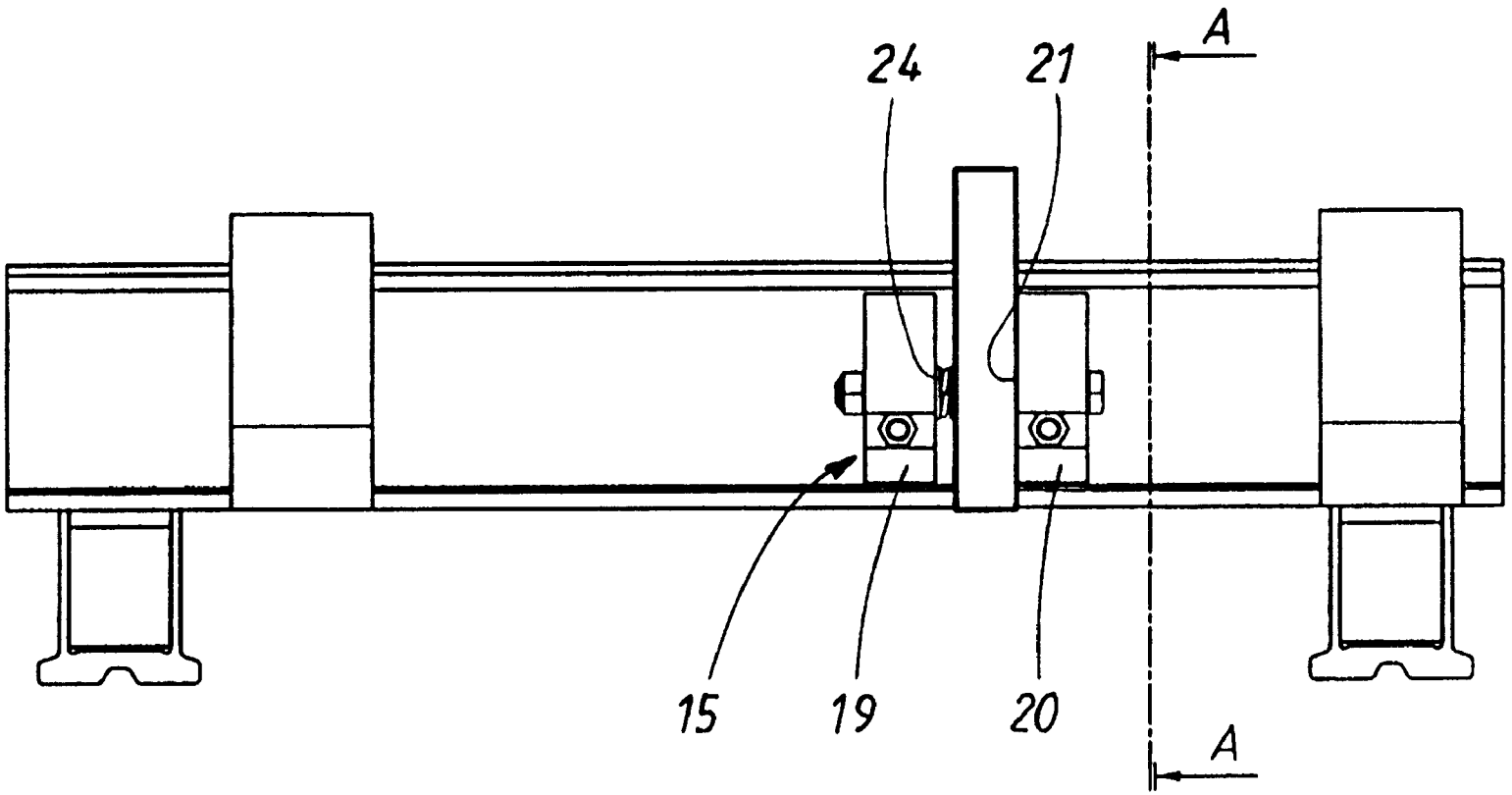
FIGS. 3 and 4 show end views of the scaffold platform with the locking device in release position and lock position, respectively.
Figure 4:
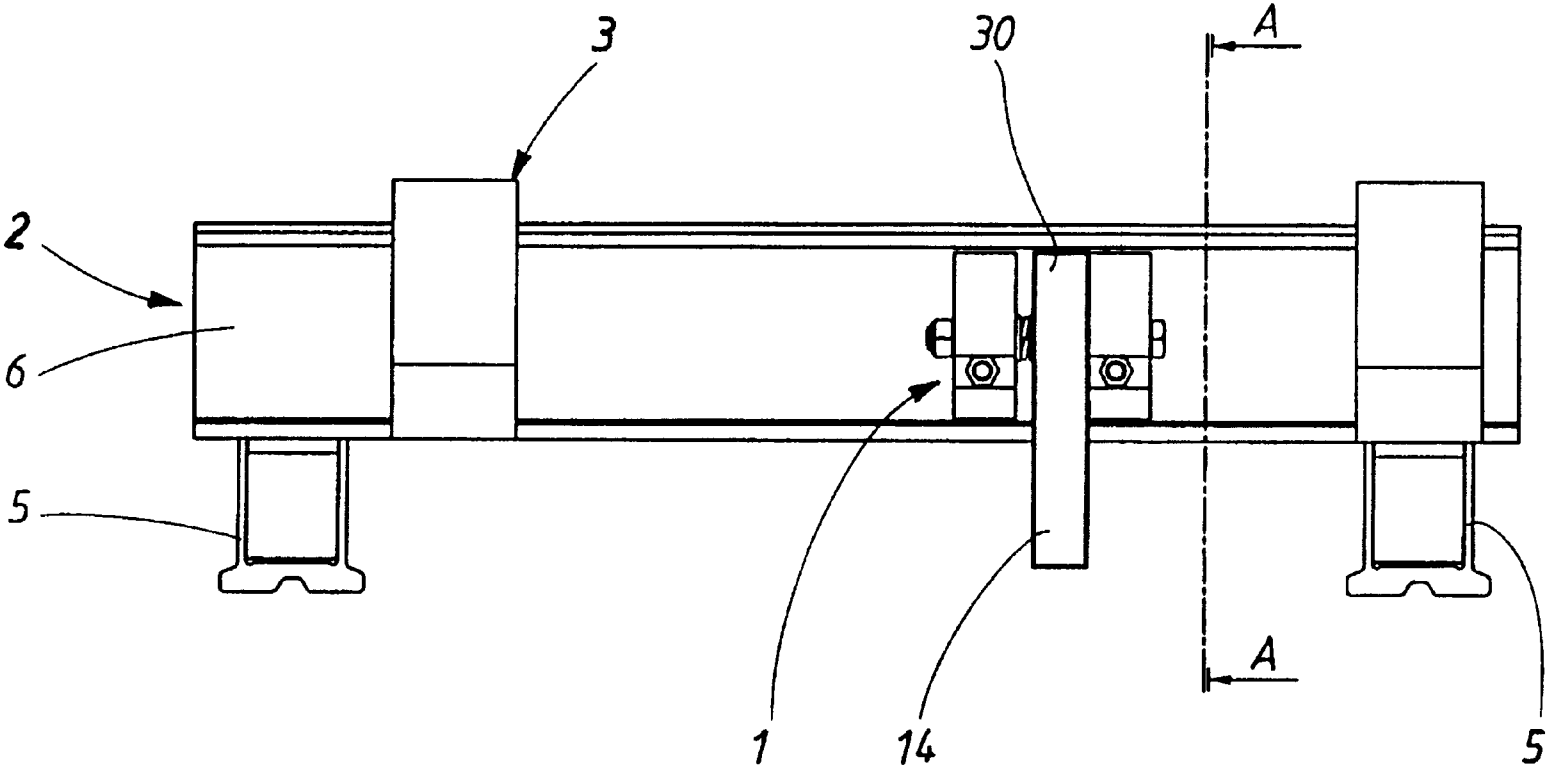
Figure 5:
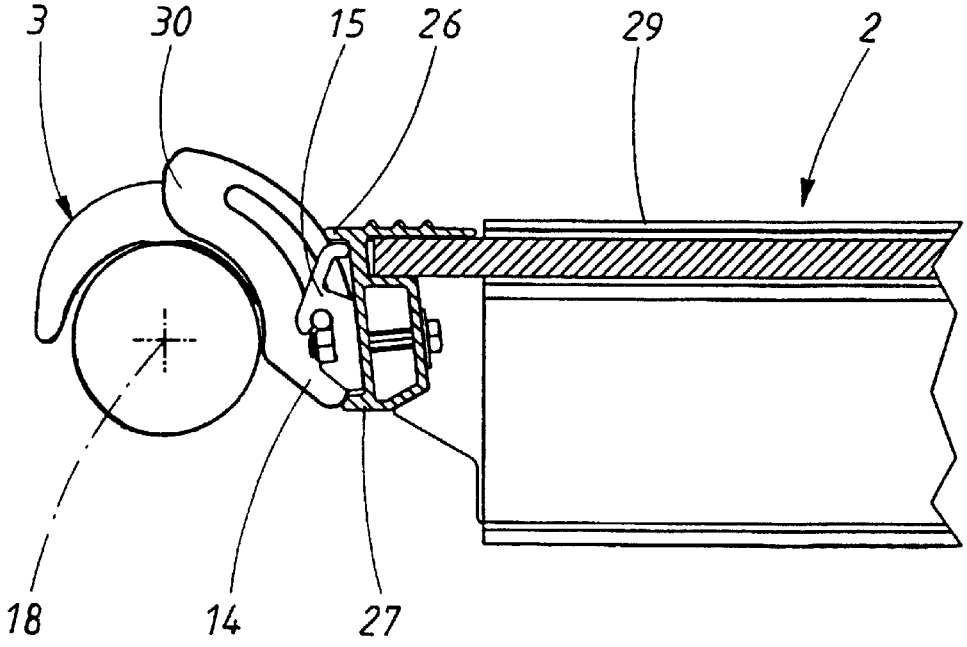
FIGS. 5 and 6 show cross sections along the line A—A in FIG. 3 and FIG. 4, respectively.
Figure 6:
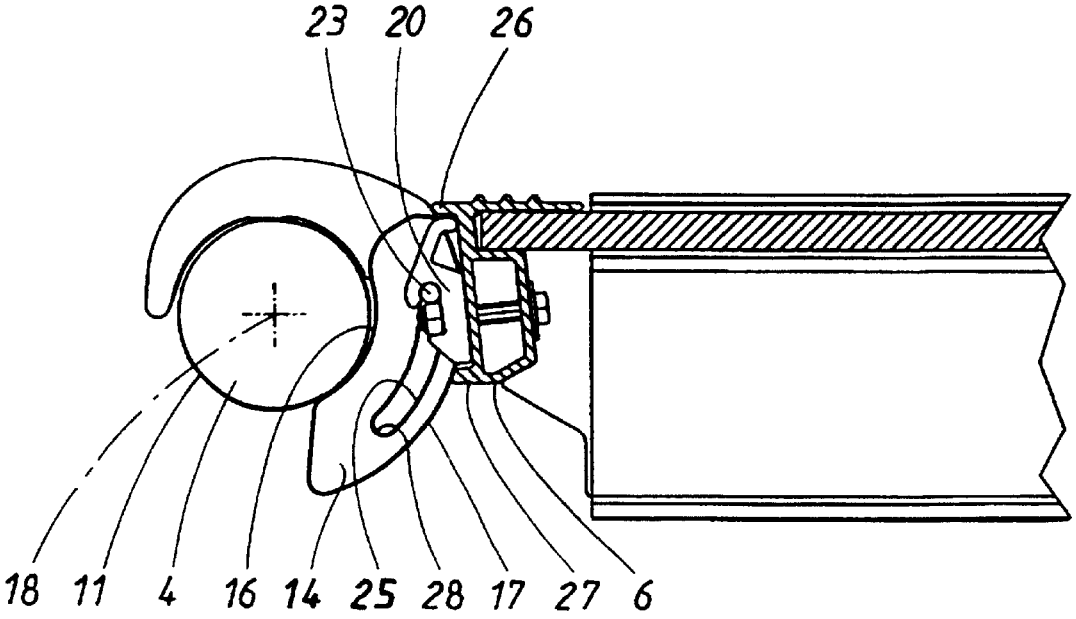
Figure 7:
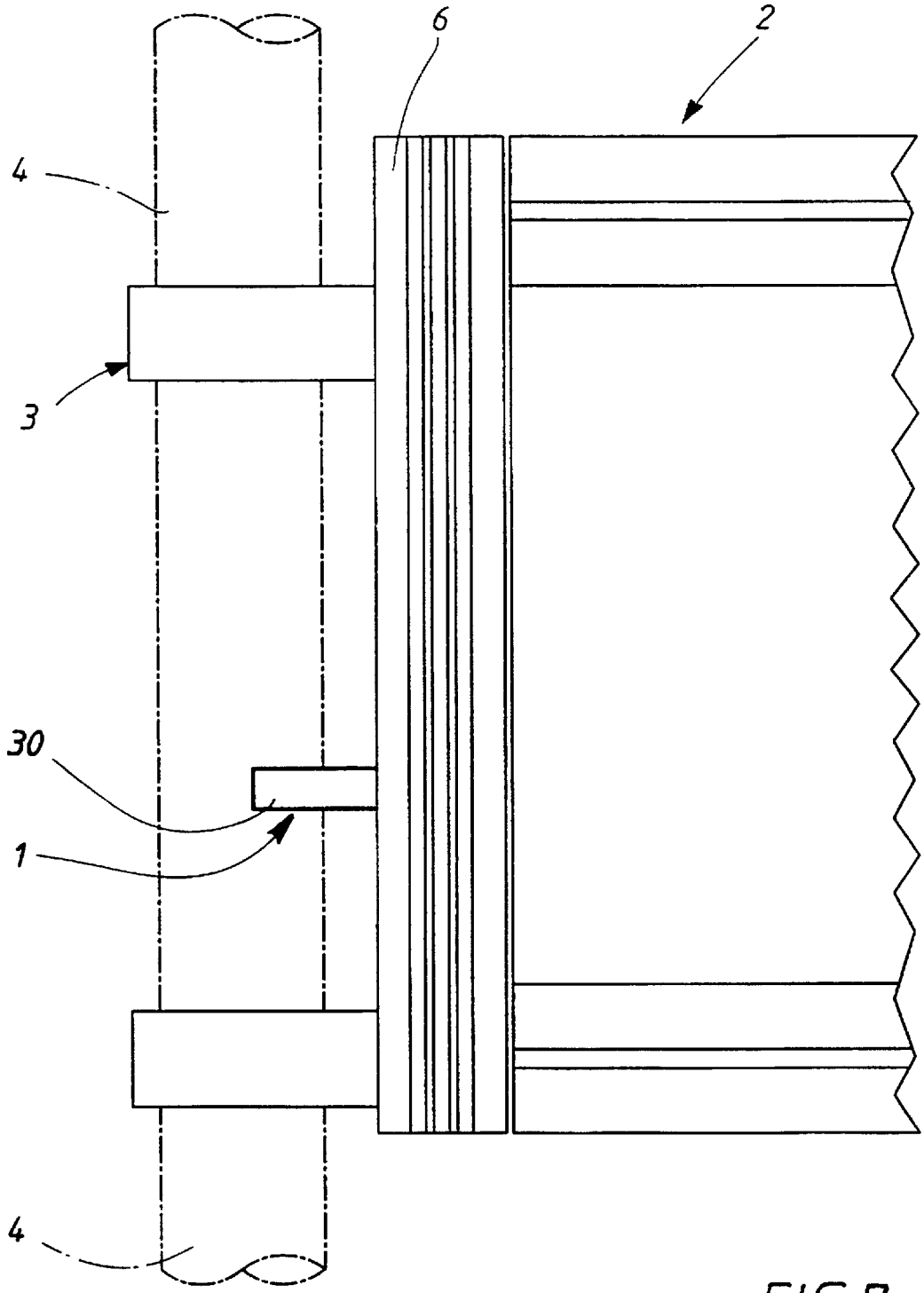
FIGS. 7 and 8 show partly broken top end elevations of the scaffold platform with the locking device in release position and lock position, respectively.
Figure 8:
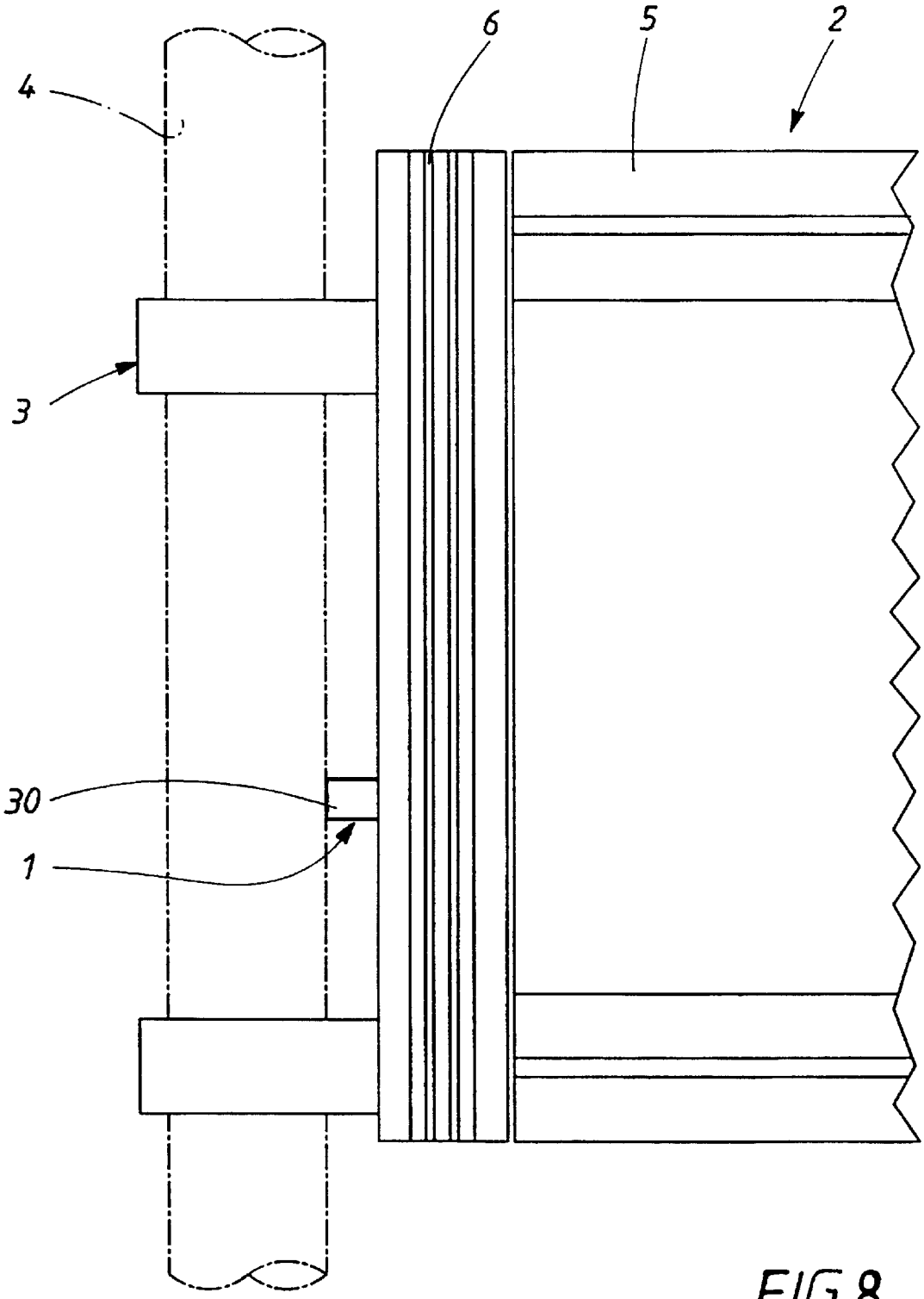

As is apparent from FIGS. 1–8, the locking device 1 according to the invention is installed on a scaffold platform 2, which is of a type that discloses a number of hook elements 3 that are installed at the ends of the platform, wherein only one of the ends is shown in the drawings. A complete platform is generally elongated and commonly discloses two hook elements at each end thereof. One single elongated hook element of a profile may possibly extend over a large part of the width of the platform, alternatively may several hook elements possibly be arranged, depending on the width of the platform. It is for that matter possible that the hook elements instead or also are arranged along the long sides in a special arrangement in order to provide a high degree of load-bearing capacity. The scaffold platform 2 is intended to form part of or to be upheld by a scaffold, of which a lying scaffold element 4 is shown in the drawings. In practice, at least two lying, essentially horizontal, scaffold elements are arranged in parallel with each other with a relative distance that is adapted to the relative distance of the hook elements in each platform. The scaffold elements 4 are suitably formed by metal pipes, which in the shown example have a circular cross-sectional form, i.e. a uniform transverse dimension with a symmetry axis which also forms a center of curvature. Generally, the scaffold also includes posts or standing elements which stand on a ground and in turn uphold the lying elements 4. A scaffold may consist of a large number of lying elements 4 which are situated on different levels and/or the same level in order to uphold a large number of platforms in a scaffold. In the shown example, the platform is made up of two parallel longitudinal profile beams 5, between which longitudinal profile beams transversal profile beams 6 extend at each end. Additional profile beams may also be arranged between the longitudinal profile beams 5. The longitudinal profile beams support a platform plane 7, which forms the upper side of the platform. Advantageously, the entire construction is made in light metal, which results in a substantial strength in relation to the weight. The rest of the scaffold elements, such as the lying scaffold elements 4, are usually pipe constructions, which in the shown example disclose a circular cross-sectional form, but may alternatively be square profiles or have another form of profile. These elements may be made either in steel or light metal.

Advantageously, the hook elements 3 are also constructed out of a hooked profile and disclose a hooked section 8 with a free hook end 9, which in the shown example points downwards in an assembled state, and an inside rest surface 10 which advantageously is adapted to the form and the dimension of the mantle surface 11 of the scaffold element 4, i.e. essentially its arched form. The rest surface 10 discloses an extension which in the shown example essentially corresponds to half the periphery of the mantle surface 11, which results in that a hook opening 12 is defined which allows the scaffold element to be inserted into and taken out of, respectively, the hook element. Furthermore, the hook element is provided with an attachment bracket 13, by means of which the hook element is fixed to the platform, in this case the profile beam 6.

The locking device 1 according to the invention is best apparent from FIGS. 3–6. The locking device consists of a locking slide 14 or latch, which is movably installed in a guide device 15 for adjustment between a release position for the scaffold element 4 and a lock position, in which the scaffold element is blocked so that the hook elements will not be unhooked. The locking slide 14 discloses a curved or bent, arched form, and has an extension which covers at least 90° of a circular arc. Thus, in the shown example, the locking slide is arc-shapely curved in order to connect to the form of the mantle surface 11 of the lying scaffold element 4. Therewith, the locking slide discloses a concavely curved arc-shaped lock surface 16 and a convexly curved guide surface 17. Advantageously, as is apparent from the drawings, the center of curvature for the locking slide 14 is not entirely coincident with the center of curvature 18 for the lying element, by means of which a locking with freedom from play can be assured between locking slide and scaffold element 4 in lock position, see FIG. 6, i.e. so that the lock surface 16 in the locking direction, i.e. downwards in FIG. 6, approaches the scaffold element 4 and in lock position advantageously partly bears against the mantle surface 11.

The guide device 15 is adapted to, on the one hand, hold the slide 14 fixed to the platform and, on the other hand, guide its adjustment movements between lock position and release position, and also assure that the locking slide in a secure manner is kept in lock position. In the shown example, the guide device discloses two attachment brackets 19, 20, which are fixed to an attachment surface of the transversal profile beam 6 in such manner that they between themselves form a gap which slightly exceeds the width of the locking slide. At least one of the attachment brackets discloses a planar guide surface 21, against which the locking slide is intended to bear with one of its sides, which also is planar and forms a guide surface 22. Furthermore, the guide device includes a guide pin 23, which extends through the, attachment brackets 19, 20 and is kept in place by means of the fact that it suitably is formed as a bolt. In the shown example, a spring washer 24 is clamped between one of the attachment brackets 19 and the locking slide 14, the purpose of which is to press the locking slide with freedom from play against the guide surface 21 in the other attachment bracket. The guide pin 23 namely extends through an arched guide slit 25 which determines the guide of the locking slide in its adjustment movement between lock position and release position. The guide slit 25 has a limited extension and forms in its ends stop bolts for the guide pin in the end positions of the locking slide. The adjustment movement is additionally guided by means of two support lists 26, 27 on the profile beam 26 by bearing against the surface 17 of the locking slide. Thus, the curved guide surface 17, in cooperation with the position of the guide device 15, determines the adjustment movement which follows a curved path, which thus advantageously brings the locking slide towards the scaffold element in lock position. In this regard, the curve of the lock surface 16 is suitably selected so that it has a radius which is less than the radius or half the transverse dimension of the scaffold element 4 or the radius of curvature of the inside rest surface 10 of the hook section 8. The same effect can be obtained by means of the same radius of curvature and a center of curvature for the locking slide 14 which has been shifted inwards.

Thus, the release position for the locking device 1 is shown in FIGS. 1, 3, 5 and 7. In this connection, the locking slide is displaced so that the guide pin 23 reaches its end position towards the lower end 28, see FIG. 6, of the guide slit 25. In this manner, the locking slide 14 protrudes exceedingly above the platform plane 29, see particularly FIGS. 1, 3 and 5. This is partly an effect of an eccentrically situated path at the locking slide. Alternatively, or in combination with this, the locking slide 14 is, as is shown in the drawings, advantageously radially thicker than the hook element 8 in its section above the scaffold element 4. Moreover, seen from above, the locking slide protrudes in a distinctly manner in relation to the transversal profile beam 6 as well, see FIG. 7, and interjects over the lying scaffold element 4. In this manner, the locking slide forms a visual indication section with one of its ends 30 which is clearly visible for an observer from the upper side of the platform as well, for example for an individual which is situated on the platform, which constitutes a distinct indication of the fact that the platform is not entirely assembled, but that adjustment to lock position is required. Consequently, the first step in the assembly is accomplished by means of the fact that the locking slide in release position is removed in such manner that the hook opening of the hook element allows the scaffold element to be inserted into the hook elements 3. Thus, there is thereby a risk that the hook elements are unintentionally unhooked due to uneven load or other disadvantageous conditions, by means of which it is particularly important that the assembly is completed by means of the locking device 1 being adjusted to lock position. This is accomplished by means of the fact that the locking slide, either manually or by means of a knock by a tool, hammer or the like, is moved towards the end section or the indication section 30, by means of which the locking slide in an arched movement is caused to be displaced in relation to the guide device to lock position, which is shown in FIGS. 2, 4, 6 and 8. In reverse, lock position is in this regard indicated by means of fact that the indication section 30 is removed from the projection or protrusion position, and is in the shown example situated below the platform plane and protrudes insignificantly from the transversal beam 6 seen from above. The guide device allows a displacement movement with a suitably adjusted friction which, apart from the sliding surfaces, is determined by the spring force in the spring washer 24, the purpose of which is to secure that lock position is maintained also during forces which strive to unhook the hook elements 3 from the scaffold element 4. A minimum requirement is that the active hook opening 12, which in the lock position of the locking slide has been considerably reduced, is smaller than the transverse dimension of the lying scaffold element 4, i.e. its diameter. In practice, the active hook opening should be considerably smaller than this dimension in order for component forces on the locking slide not to act to adjust this to release position. At the same time, the locking slide should not be made unnecessarily long in order to avoid bending stresses in this. A suitable opening angle in lock position is, for example, as in the shown example, approximately 90°.

By means of the locking device according to the invention, an extremely simple visual or ocular indication is by means of simple means obtained of whether the locking is adjusted to lock position or not. A signal colour or a brightly coloured other marking on the locking slide may, for that matter, possibly be arranged on the indication section 30, for example a plastic pin which is bored through the locking slide.

The invention is not limited to the embodiments which are described above and shown in the drawings, but may be varied within the scope of the appended claims. For example, the guide device can be constructed in a number of different ways, such as in the form of a guide casing in which the locking slide runs. The hooked sections 8 can have a rest surface 10 which has another form that is adapted to another cross-sectional form of the scaffold element in question, e.g. polygonal, e.g. quadrangular with sharply or rounded-off corners.

What is claimed is:

1. A locking device for a scaffold platform having an upper side, comprising:

a. a guide device having a guide pin, a first bracket and a second bracket, the first bracket having a first guide surface; and b. a locking slide having a release position, a lock position and a guide slit, the locking slide being disposed between the first bracket and the second bracket so that the guide pin is received in the guide slit, the locking slide being brought to bear against the first guide surface by a spring force so as to guide movement of the locking slide, the locking slide having an end carrying an indication that is visible from the upper side of the scaffold platform when the locking slide is in the release position.

2. The device of claim 1, wherein in the locking slides have a curved shape and is moveable in the guide device along a curved path.

3. The locking device of claim 1, wherein the radial dimension of the locking slide is larger than the radial dimension of the hook element so that the locking slide is visible and has the indicating section protruding above the hook element.

4. The locking device of claim 2, wherein the locking slide has less play in the lock position than in the release position.

5. The locking device of claim 4, wherein the central of curvature for the locking slide is eccentric in relation to the center curvature for the scaffold element to be engaged by the locking device.

6. The locking device of claim 3, wherein the locking slide bears against the scaffold element in the locked position.

* * * * *

UNITED STATES PATENT AND TRADEMARK OFFICE

CERTIFICATE OF CORRECTION

PATENT NO. : 6,530,456 B1
DATED : March 11, 2003
INVENTOR(S) : Harry Wallther

It is certified that error appears in the above-identified patent and that said Letters Patent is hereby corrected as shown below:

Title page,
Item [57], ABSTRACT, delete the Abstract, and insert the following Abstract:

--The present invention relates to a locking device (1) for scaffold platforms (2) which are provided with a number of hook elements (3) which protrude from at least two sides (3) of the platform in order to, when mounted, be hooked up on lying scaffold elements (4) in a scaffold. The locking device is adjustable between a release position, in which the platforms can be unhooked from accompanying scaffold elements, and a lock position, in which the platform is locked to the scaffold element. The locking device is constituted by a displaceable locking slide which is movable in a guide device between, on the one hand, the release position, in which the accompanying scaffold element can be inserted into and taken out of, respectively, the hook elements and, on the other hand, the lock position, in which the slide blocks the scaffold element in the hook elements. The locking slide is provided with an indication section, which follows the locking slide's adjustment movement between release position and lock position. In release position, the locking slide protrudes clearly visible for an observer from the upper side of the platform for ocular indication that the platform is unlocked.--

Column 1,
Line 21, "load" should read -- loads --.

Column 2,
Line 54, after "beams" (first instance) insert -- and --.

Column 3,
Line 50, after "the" delete ",".

Column 4,
Line 20, "distinctly" should read -- distinct --.

Column 6,
Line 8, delete "is" and insert therefor -- are --.
Line 18, delete "central" and insert therefor -- center --.

Signed and Sealed this

Thirtieth Day of September, 2003

JAMES E. ROGAN
*Director of the United States Patent and Trademark Office*